US008002536B2

(12) United States Patent
Ness et al.

(10) Patent No.: US 8,002,536 B2
(45) Date of Patent: Aug. 23, 2011

(54) CONCRETE BLOCK MACHINE HAVING A CONTROLLABLE CUTOFF BAR

(75) Inventors: John T. Ness, Stillwater, MN (US); Jeffrey A. Ness, Oak Park Heights, MN (US)

(73) Assignee: Ness Inventions, Inc., St. Paul, MN (US)

( * ) Notice: Subject to any disclaimer, the term of this patent is extended or adjusted under 35 U.S.C. 154(b) by 0 days.

(21) Appl. No.: 12/500,931

(22) Filed: Jul. 10, 2009

(65) Prior Publication Data

US 2010/0007051 A1 Jan. 14, 2010

(51) Int. Cl.
*B28B 13/04* (2006.01)

(52) U.S. Cl. ..... 425/217; 425/219; 425/258; 425/447

(58) Field of Classification Search ..... 249/112; 425/64, 217, 218, 219, 258, 447, 449
See application file for complete search history.

(56) References Cited

U.S. PATENT DOCUMENTS

| | | | | |
|---|---|---|---|---|
| 2,821,005 | A | 1/1958 | Davis | |
| 2,948,043 | A * | 8/1960 | Gory | 425/168 |
| 3,885,900 | A * | 5/1975 | Kanta | 425/219 |
| 3,942,923 | A * | 3/1976 | Binion | 425/64 |
| 4,035,124 | A * | 7/1977 | Balhorn | 425/139 |
| 4,131,670 | A * | 12/1978 | Abate | 264/256 |
| 4,272,230 | A * | 6/1981 | Abate | 425/64 |
| 4,936,763 | A * | 6/1990 | Thomas | 425/64 |
| 6,998,075 | B2 * | 2/2006 | Sandqvist | 264/33 |
| 7,470,121 | B2 * | 12/2008 | Ness et al. | 425/195 |

FOREIGN PATENT DOCUMENTS

| | | |
|---|---|---|
| EP | 0659526 | 6/1995 |
| EP | 0685350 | 6/1995 |
| JP | 53 61618 | 6/1978 |
| WO | 9823424 | 6/1998 |

OTHER PUBLICATIONS

Search Report for application PCT/US2009/050259, mailed Jun. 11, 2009, 13 pgs.
Besser Company, Sales Orders, Parts Lists, Correlation Sheet, Brochures, Drawings, 29 pages.

* cited by examiner

*Primary Examiner* — Yogendra N Gupta
*Assistant Examiner* — Emmanuel S Luk
(74) *Attorney, Agent, or Firm* — Dicke, Billig & Czaja, PLLC

(57) ABSTRACT

A concrete block machine including a mold having at least one mold cavity, a feedbox driven back and forth between retracted and extended positions, wherein the feedbox is positioned over a top of the mold deposits concrete in the at least one mold cavity when at the extended position, a cutoff bar coupled to the feedbox and including a moveable cutoff element, and a drive system. The drive system is coupled to the moveable cutoff element and moves the moveable cutoff element to adjust a distance between the moveable cutoff element and the top of the mold as the feedbox is driven from the extended position to the retracted position such that the moveable cutoff element removes varying amounts of concrete deposited in the mold cavity so that a depth of concrete remaining in the mold cavity varies in a desired fashion in a direction of movement of the feedbox.

20 Claims, 19 Drawing Sheets

CONCRETE BLOCK MACHINE HAVING A CONTROLLABLE CUTOFF BAR

CROSS-REFERENCE TO RELATED APPLICATIONS

This Utility Patent Application claims priority to U.S. Provisional Patent Application No. 61/079,661, filed on Jul. 10, 2008, which is incorporated herein by reference.

BACKGROUND

Concrete blocks, often referred to as concrete masonry units (CMU's), are typically manufactured by forming them into various shapes as part of an automated process employing a concrete block machine. Such concrete block machines employ a mold having one or more cavities in which a block is formed, with each cavity having a shape of the block desired to be formed. The mold is bolted onto/into the concrete block machine and has an open top and an open bottom.

During a block forming process, a pallet is moved by a conveyor system onto a pallet table which, in turn, is moved upward until the pallet contacts the mold and forms a bottom for each of the one or more mold cavities. A feedbox filled with dry cast concrete is then moved from a retracted or withdrawn position to an extended position above the mold frame where it fills the one or more mold cavities with dry cast concrete via the open top. A cutoff bar which is fixed-mounted to the feedbox assembly scrapes or wipes away excess dry cast concrete from the top of the mold cavities as the feedbox is driven back to the retracted position. The block machine then moves a head shoe into the mold cavities via their open tops and compresses the dry cast concrete to a desired psi (pounds-per-square-inch) rating while simultaneously vibrating head shoe, mold cavity, pallet, and pallet table.

As a result of the compression and vibration, the dry cast concrete reaches a level of "hardness" which enables the resulting molded blocks to be immediately removed from the mold cavities. To remove the molded blocks from the cavities, the mold remains stationary while the head shoe, pallet, and pallet table move downward and force the molded blocks from the mold cavities. The conveyor system then moves the pallet bearing the molded blocks away to be cured and a clean pallet takes its place. This process is continuously repeated in an automated fashion to produce additional blocks.

For many types of CMUs (e.g. pavers, patio blocks, lightweight blocks, cinder blocks, etc.), retaining wall blocks and architectural units in particular, it is desirable for at least one surface of the block to have a desired texture, such as a stone-like texture, for instance. When arranged to form a structure with the textured surface being visible, the structure will have the appearance of being constructed from natural stone, for example.

One technique for creating a desired texture on a block surface is to provide a negative of a desired texture or pattern on a moveable side wall of a mold cavity. During the block forming process, the moveable side wall is moved to an extended position to form the mold cavity. As described above, the mold cavity is then filled with dry cast concrete and compressed/vibrated. The moveable side wall is then moved to a retracted position and the molded block having the textures surface is removed from the mold cavity for curing, as described above. Textured block surface can also be formed by shearing or splitting off a block face as the molded block is removed from the mold cavity through use fixed studs extending from and forming a texture of sorts on a corresponding side wall of the mold cavity.

While such techniques are effective at forming textured surface on the molded blocks, air pockets trapped between the textured surface of the side walls of the mold cavity and dry cast concrete filling the mold cavity are forced out during the compression/vibration process, causing the concrete to settle along the side wall of the mold cavity forming the textured block surface. As a result, the textured surface of the block may not be completely formed and the molded block may have a height along the textured surface (e.g. front face of block) which is shorter than that along an opposite surface (e.g. rear face of block).

To compensate for the settling of the dry cast concrete, the fixed cutoff bar is sometimes made to be narrower along its edges than at its middle. As a result, as the feedbox is moved to its retracted position and the cutoff bar is drawn across the top of the concrete-filled mold cavity, more dry cast concrete is left along the edges of the mold cavity which are parallel to the direction of travel of the feedbox than in the middle of the mold and along edges which are perpendicular to direction of feedbox travel. While such a technique is generally successful at providing more concrete for a textured surface when the textured surface of the block is located along edges of the mold cavity parallel to the direction of travel of the feedbox, it does not work when the textured side walls (e.g. the moveable side walls) and thus the textured surface of the molded block are along edges of the mold cavity which are perpendicular to the direction of travel of the feedbox.

SUMMARY

One embodiment provides an automated concrete block machine including a mold having at least one mold cavity, a feedbox driven back and forth between retracted and extended positions, wherein the feedbox is positioned over a top of the mold deposits concrete in the at least one mold cavity when at the extended position, a cutoff bar coupled to the feedbox and including a moveable cutoff element, and a drive system. The drive system is coupled to the moveable cutoff element and moves the moveable cutoff element to adjust a distance between the moveable cutoff element and the top of the mold as the feedbox is driven from the extended position to the retracted position such that the moveable cutoff element removes varying amounts of concrete deposited in the mold cavity so that a depth of concrete remaining in the mold cavity varies in a desired fashion in a direction of movement of the feedbox.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
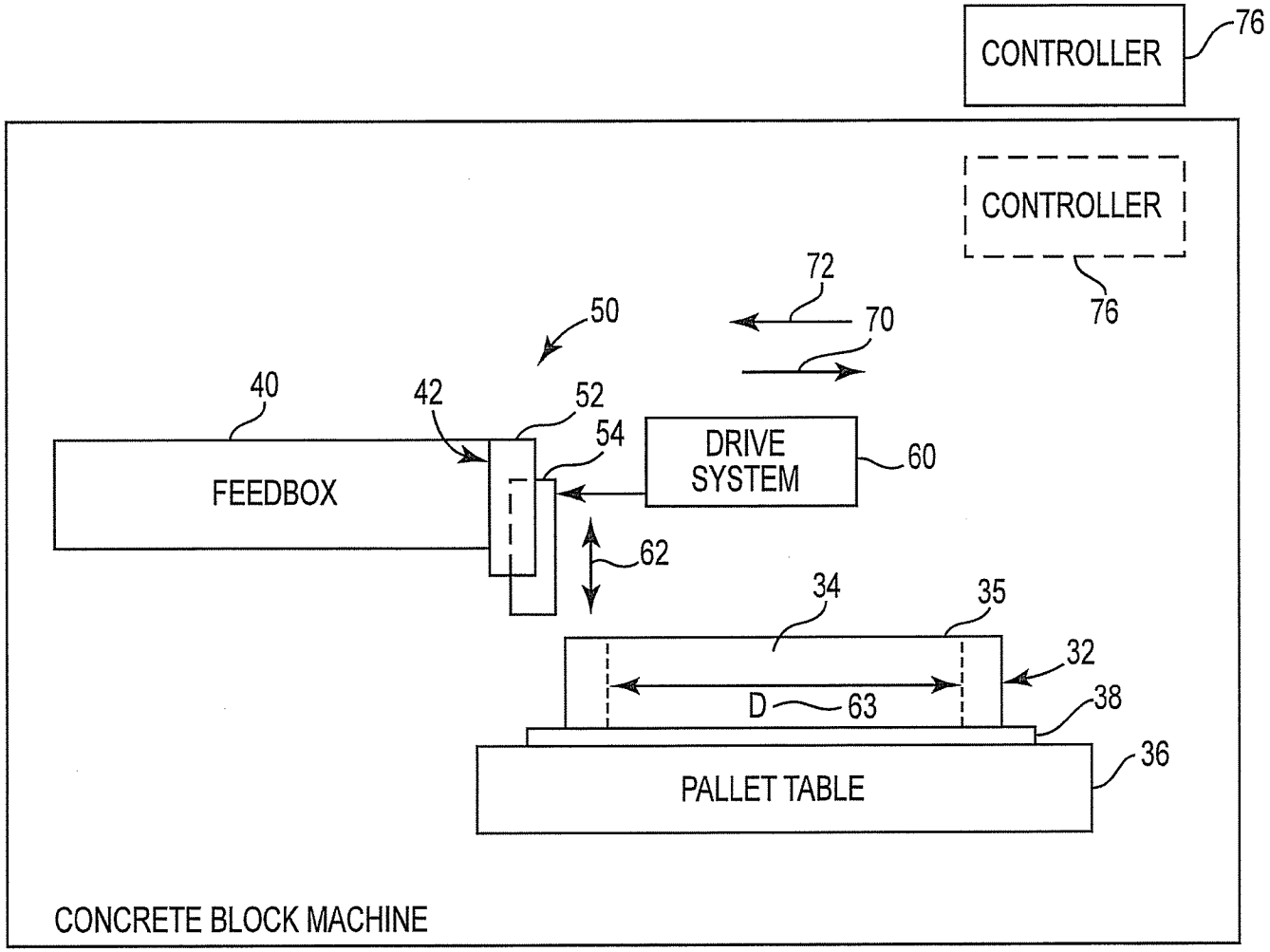
FIG. 1 is a block diagram generally illustrating a concrete block machine employing a controllable cutoff bar according to one embodiment.

FIG. 1 is block diagram generally illustrating one embodiment of an automated concrete block machine 30 employing a cutoff bar, wherein at least a portion of the cutoff bar can be controllably moved up and down relative to the open top of a mold so as to control and vary a depth of dry cast concrete filling mold cavities in a direction of feedbox travel as desired. A controllable cutoff bar according to the present disclosure can be adapted for use in any suitable automated concrete block machine 30, such as those machines manufactured by Besser Company (Alpena, Mich.) and Columbia Machine, Inc. (Vancouver, Wash.), for example.

According to the embodiment of FIG. 1, concrete block machine 30 includes a mold 32 including at least one mold cavity 34, a moveable pallet table 36 supporting a pallet 38, and a feedbox 40. A cutoff bar 50 includes a fixed portion 52 coupled to an end wall 42 of feedbox 40, and a moveable cutoff element 54 coupled to a drive system 60.

As illustrated in FIG. 1, pallet table 36 is in a position where pallet 38 contacts mold 32 and forms a bottom for mold cavity 34, and feedbox 40 is in a retracted or withdrawn position where it is removed from an open top 35 of mold 32. In operation, concrete block machine 30 drives feedbox 40, along with cutoff bar 50 and at least portions of drive system 60, which will be described in greater detail below, from the retracted position in a first direction, as indicated by directional arrow 70, to an extended position over open top 35 of mold 34 where it deposits dry cast concrete in mold 34. According to one embodiments of the present disclosure, as feedbox 40 is returned to the retracted position, in a second direction as indicated by directional arrow 72, drive system 60 controllably moves moveable cutoff element 54 up and down relative to open top 34 of mold 32, as indicated by the double arrow 62, so as to removed varying amounts of concrete deposited in mold cavity 34 such that a depth of dry cast concrete remaining in mold cavity 34 varies in a desired fashion across a dimension D, as indicated at 63, in the direction of movement of feedbox 40.

According to one embodiment, which will described in greater detail below, a controller 76, such as a programmable logic controller (PLC), for example, controls the movement of moveable cutoff element 54 based on a position of feedbox 40 over mold 32 as it is moved between the extended and retracted positions. According to one embodiment, controller 76 is separate from concrete block machine 30, as illustrated by the solid box. According to one embodiment, controller 76 is incorporated as part of concrete block machine 30, as indicated by the dashed box.

Figure 2:
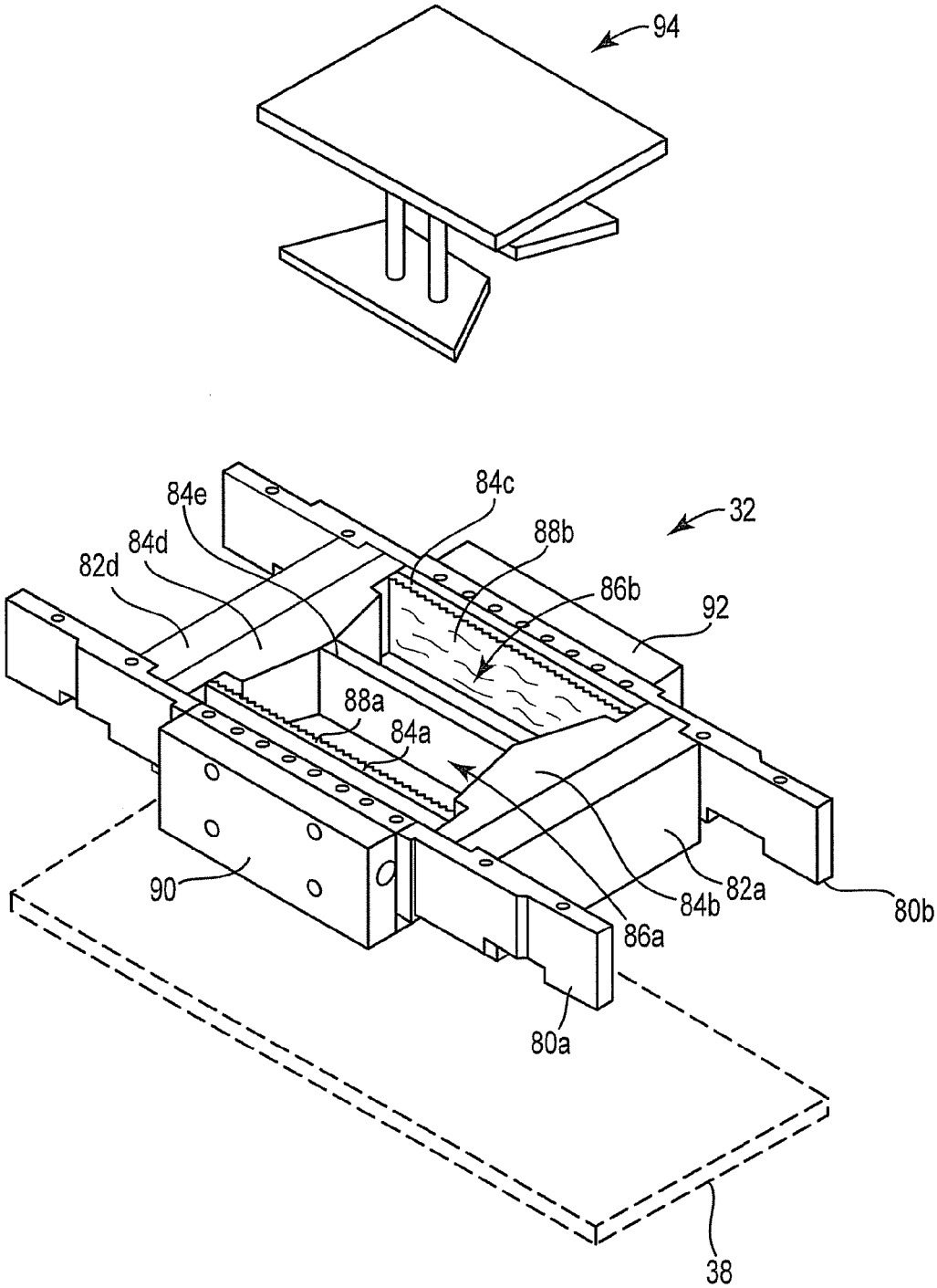
FIG. 2 is a perspective view illustrating generally a mold suitable for use with the concrete block machine of FIG. 1.

FIG. 2 is a perspective view illustrating generally an example a mold for molding dry cast concrete blocks having at least one textured surface, or face, and which is suitable for use as mold 32 of FIG. 1. As illustrated by FIG. 2, mold 32 includes a mold frame having side-members 80*a* and 80*b* and cross-member 82*a* and 82*b* that are coupled to one another to form framework in which a plurality of liner plates 84, illustrated as liner plates 84*a*, 84*b*, 84*c*, 84*d*, and 84*e* are positioned so as to form a mold cavity comprising a pair of mold cavities 86*a* and 86*b*, wherein the plurality of liner plates are positioned to form a desired shape of a masonry block to be formed therein.

In one embodiment, as illustrated, liner plates 84*a* and 84*c* are moveable between retracted and desired extended positions within mold cavities 88*a* and 88*b*, while liner plates 84*b*, 84*d*, and 84*e* are stationary. In one embodiment, moveable liner plates 84*a* and 84*c* include liner faces 86*a* and 86*c* which have a negative of a desired texture, pattern, or other design to be formed on a face of a dry cast concrete block to be molded within mold cavities 86*a* and 86*b*. Mold 32 further include drive assemblies 90 and 92 which are selectively coupled to and configured to drive moveable liner plates 40*a* and 40*c* so as to drive moveable liner faces 44*a* and 44*c* between the retracted and desired extended positions within mold cavities 42*a* and 42*c*. Examples of drive assemblies suitable for use with mold assembly 30 are described by U.S. Pat. Nos. 7,156,645 and 7,261,548 assigned to the same assignee as the present invention.

In one embodiment, mold assembly 30 is bolted to concrete block machine 30 via side members 80*a* and 80*b*. In one embodiment, mold assembly 32 further includes a head shoe assembly 94 having dimensions substantially matching those of mold cavities 86*a* and 86*b*, and which is also coupled to concrete block machine 30. During formation of a masonry block, head shoe assembly 94 and a pallet 38 respectively form a top and a bottom of mold cavities 86*a* and 86*b*.

Figure 3:
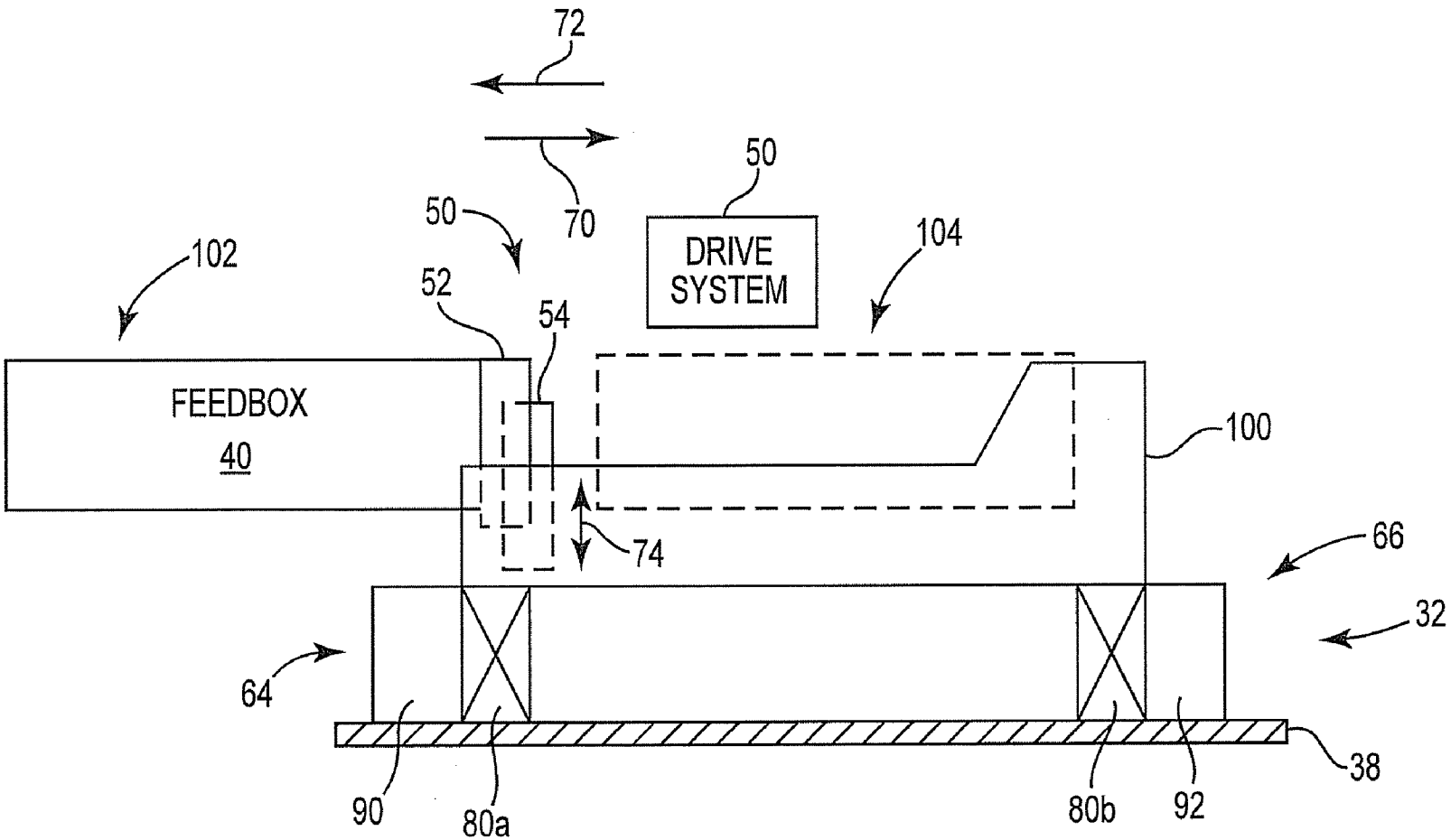
FIG. 3 is a block diagram illustrating portions of the concrete block machine of FIG. 1 including the mold assembly of FIG. 2, according to one embodiment.

FIG. 3 is a side view generally illustrating portions of concrete block machine 30 of FIG. 1 after mold assembly 32 of FIG. 2 has been mounted thereto. According to one embodiment, a top plate assembly 100 is mounted to the top of mold cavity 32 in order to better confine dry cast concrete provided by feedbox 40 to the area of the mold cavity or cavities, such as mold cavities 86*a* and 86*b*. According to the embodiment of FIG. 3, it is noted that side member 80*a* and drive assembly 90 are positioned at a so-called back side 64 of mold 32 and that side member 80*b* and drive assembly 92 are positioned at aso-called front side 66 of mold 32 (front and back being relative to concrete block machine 30). As such, the textured faces of dry cast concrete blocks to be formed in mold cavities 86*a* and 86*b* are positioned along sides of mold 32 that correspond to the back and front sides of concrete block machine 30, and which are perpendicular to the direction of travel of feedbox 40.

In operation, to fill mold cavities 86*a* and 86*b* with concrete, feedbox 40 is driven from a retracted position at the back of concrete block machine 30 (as indicated by the solid lines at 102) in direction 70 to an extended position (illustrated by the dashed lines at 120) within top plate 100 and over open top 35 of mold 32 at the front side of concrete block machine 30. At extended position 104, feedbox 40 deposits dry cast concrete in mold cavities 86*a* and 86 and is driven back in direction 72 from the front side 66 to retracted position 102 at back side 64 of concrete block machine 30. As feedbox 60 is returned to retracted position 102 in direction 72, moveable cutoff element 54 is drawn across the open top 35 of mold assembly 30 and drive system 60 controllably moves moveable cutoff element 54 up and down relative to open top 35 of mold 32, as indicated by the double arrow 62, so as to remove varying amounts of concrete deposited in mold cavity 34. According to one embodiment, as will be described in greater detail below, drive system 60 controllably moves moveable cutoff element 54 so as to provide a greater depth of dry cast concrete at the front and back sides of mold 32 corresponding to moveable liner plates 84*a* and 84*c* having textured liner faces 88*a* and 88*b* of mold cavities 86*a* and 86*b*, and a less depth of dry cast concrete in the middle portion of mold 32 corresponding to stationary liner plate 84*e* which separates mold cavities 86*a* and 86*b* from one another.

Figure 4:
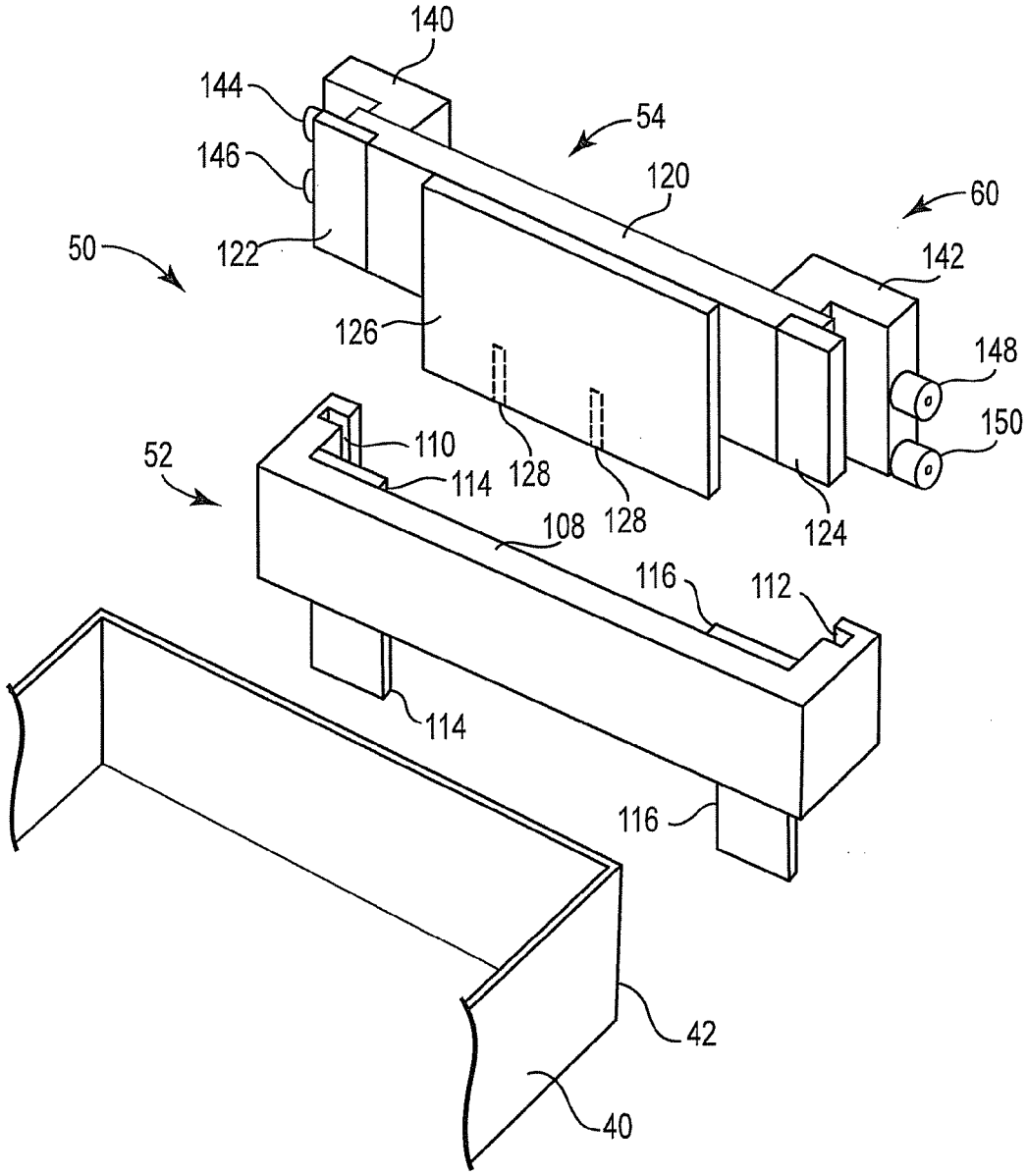
FIG. 4 is an exploded view illustrating a controllable cutoff bar and portions of a drive system according to one embodiment.
Figure 5:
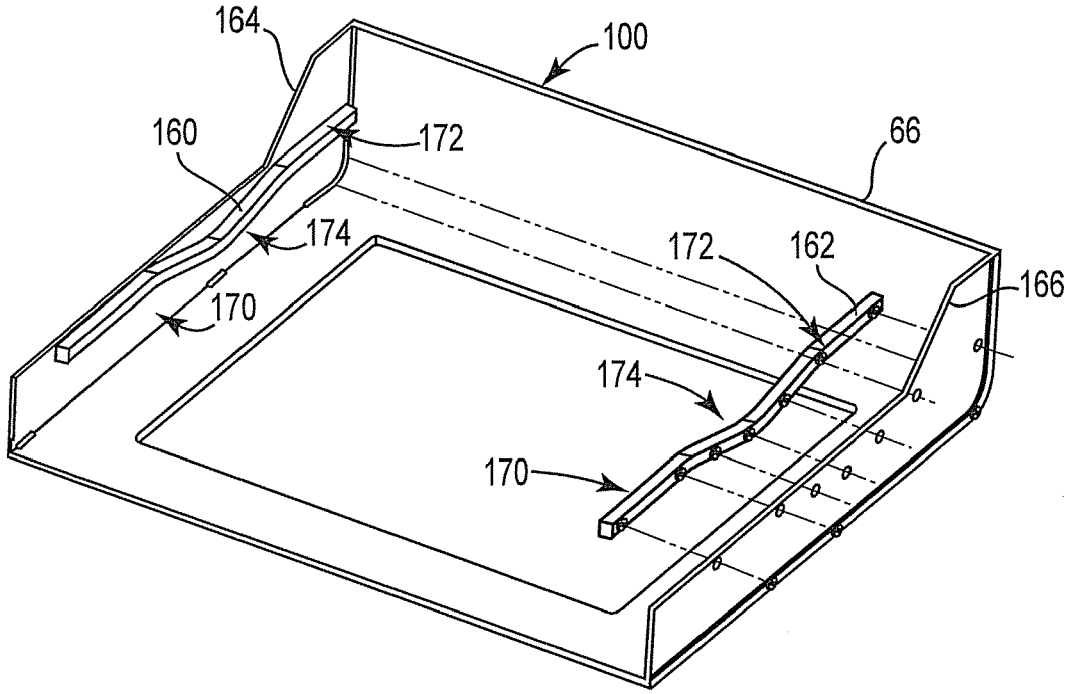
FIG. 5 is a top plate including portions of a drive system according to one embodiment.

FIGS. 4 and 5 illustrate cutoff bar 50 and drive system 60 according to embodiments of the present disclosure. FIG. 4 is an exploded view illustrating cutoff bar 50 and portions of drive system 60, according to one embodiment. According to the illustrated embodiment, cutoff bar 50 includes a fixed portion 52 and a moveable cutoff element 54. Fixed portion 52 includes an element 108 which mounted to end wall 42 of feedbox 40, such as by bolts, for example, and includes a pair of channels 110 and 112. According to one embodiment, one or more fixed wiper or scraper elements, such as wiper elements 114 and 116, which wipe or scrape away dry cast concrete from mold 32 as feedbox 40 moves from the extended position to the retracted position, but which remain fixed and are not controllably moved up and down relative to mold 32 by drive system 60.

Moveable cutoff element 54 includes a plate 120 to which guides 122 and 124 are coupled, with guides 122 and 124 configured to insert into and slide within channels 110 and 112 of fixed portion 52. According to one embodiment, guides 122 and 124 comprise a plastic material and can be readily replaced after becoming worn. A wiper or scraper element 126 is coupled to plate 120 and which is configured to move up and down and scrape away varying amounts of dry cast concrete as feedbox 40 moves from the extended position to the retracted position and moveable cutoff element 54 is controllably moved up and down relative to mold 32 by drive system 60. According to one embodiment, scraper element 126 includes a plurality of slots 128 which enable scraper element to receive and ride over division or core plates when mold 32 employs such division plates or core plates which are positioned parallel to one another in the direction of movement of feedbox 40 (see FIGS. 16 and 17).

FIG. 4 further illustrates a portion of drive system 60, according to one embodiment, which includes a pair of carriage elements 140 and 142 which are mounted to opposite ends of plate 120 of moveable cutoff element 54. A first pair of rollers 144 and 146, and a second pair of roller 148 and 150 are respectively mounted to carriage elements 140 and 142. Moveable cutoff element 54, along with carriages 140, 142 and first and second pairs of rollers 144, 146, 148, 150, are free to slide up and down within channels 110 and 112 of fixed portion 52 of cutoff bar 50 via guides 122 and 124.

FIG. 5 is a perspective view of top plate 100 and illustrates a further portion of drive system 60, according to one embodiment. As illustrated, drive system 60 further includes a pair of male rails 160 and 162 which are respectively mounted to an interior surface of opposing sidewalls 164 and 166 of top plate 100 which are parallel to the direction of travel of feedbox 40. According to one embodiment, rails 160 and 162 are formed as part of top plate 100. As will be described in greater detail below, first pair of rollers 144, 146 and second pair of rollers 148, 150 are respectively configured to engage and ride along rails 160 and 162 as feedbox 40 moves between the extended and retracted positions.

Figure 6:
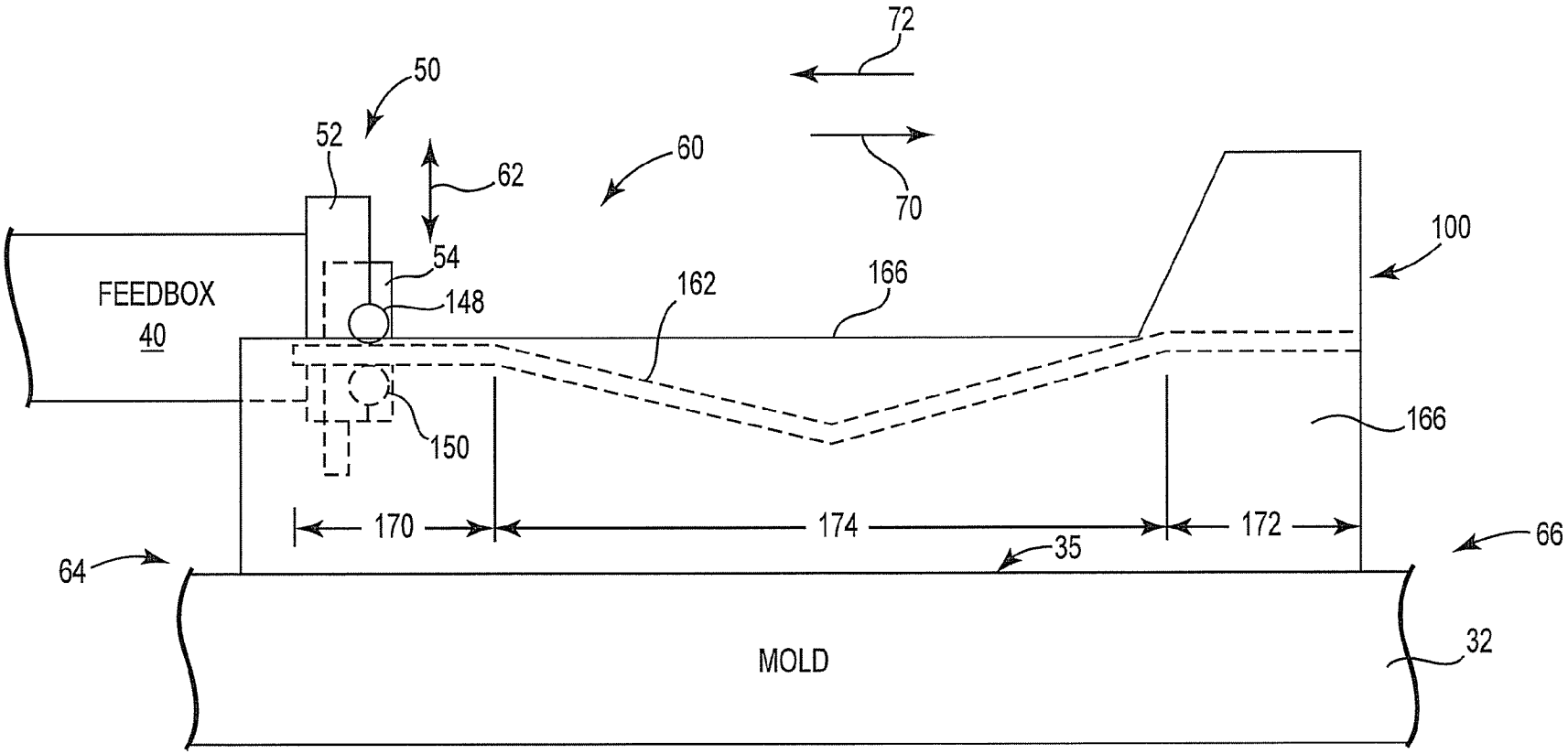
FIG. 6 is a block and schematic diagram illustrating portions of a concrete block machine according to one embodiment.

FIG. 6 is a side view of feedbox 40 and mold 32 having top plate 100 mounted thereto. It is noted that only rail 162 and the second pair of rollers 148 and 150 are illustrated in FIG. 6. The remaining rail 160 and the first pair of rollers 144 and 144 are positioned on the opposite end of cutoff bar 50 as illustrated above by FIGS. 4 and 5. According to one embodiment, rail 162 (and also rail 160, see FIG. 5) is mounted to an interior surface of sidewall 78 of top plate 100 and is parallel to the travel directions 70, 72 of feedbox 40. Rails 160 and 162 have end sections 170 and 172 which are positioned at a greater height or distance above mold 32 than a central section 174 which transitions to a distance which is nearer to open top 35 of mold 32. The second pair of rollers 148, 150 engage rail 162, and the first pair of rollers 144, 146 engage rail 160 at the opposite end of cutoff bar 50. Moveable cutoff element 54, along with first and second pairs of rollers 144, 146, 148, and 150, are slideably mounted to fixed portion 52 of cutoff bar 50 and are free to move vertically up and down relative to open top 35 of mold 32, as indicated by directional arrow 62.

Figure 7:
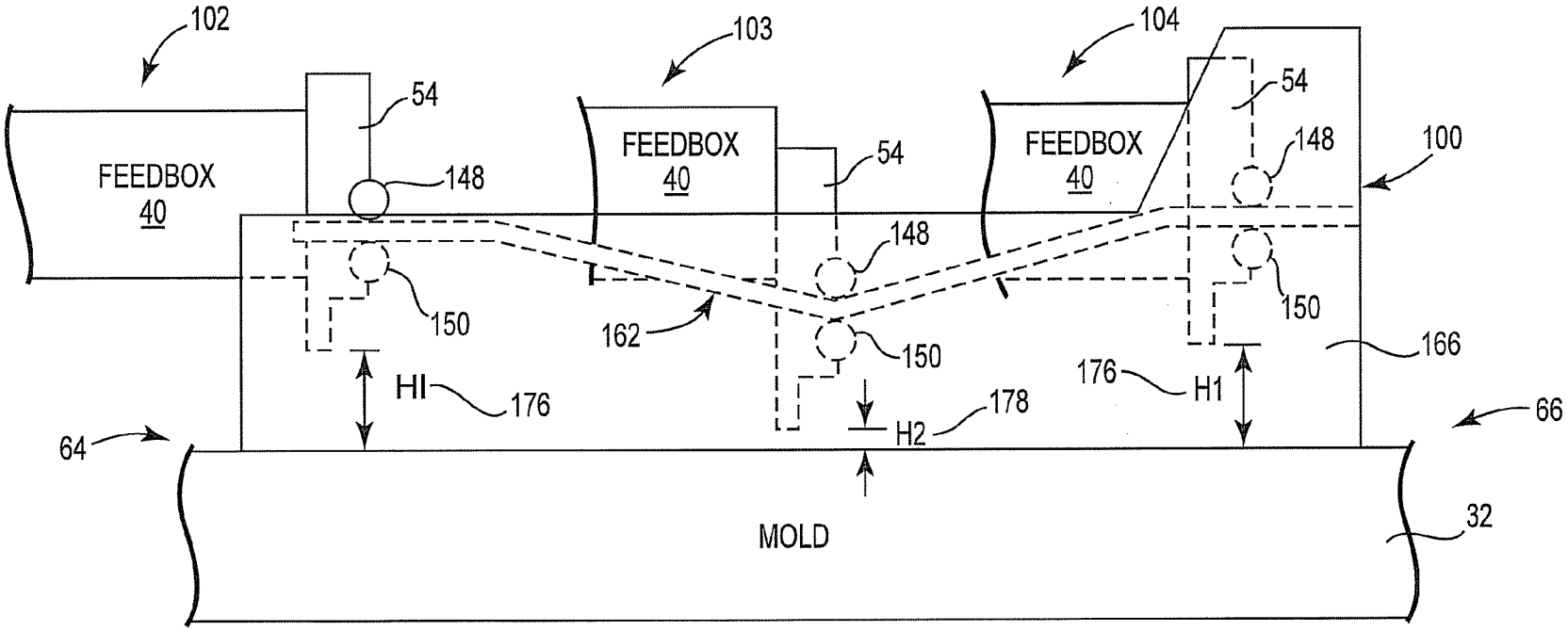
FIG. 7 is a block and schematic diagram illustrating portions of concrete block machine according to one embodiment.

FIG. 7 is a side view illustrating the operation of cutoff bar 50 and drive system 60, and shows the vertical movement of the moveable cutoff element 54 as it moves along and is guided by first and second pairs of rollers 144, 146 and 148, and 150 riding on rails 160 and 162 of drive system 60. The description of FIG. 7 begins with feedbox 40 being at extended position 104. After feedbox 40 deposits dry cast concrete in mold cavities 86*a* and 86*b* of mold 32, feedbox 40 is driven form extended position 104 to retracted position 102.

Initially, the first pair of rollers 144, 146 and the second pair of rollers 148, 150 are located at end seconds 172 of rails 160 and 162 such that wiper element 126 of moveable cutoff element 54 is at a height H1 above open top 35 of mold 32, as indicated at 176. As feedbox 40 is moved in direction 72 toward retracted position 102, first and second pairs of rollers 144, 146, 148, and 150 follow rails 160 and 162 and transition downward in central section 174 such that moveable cutoff element 54 transitions vertically downward toward mold 32 until feedbox 40 reaches an intermediate position 103 where wiper element 126 is at a height H2 above open top 35 of mold 32, as indicated at 178. As feedbox 40 continues to move in direction 72 to retracted position 102, first and second pairs of rollers 144, 146, 148, and 150 follow rails 160 and 162 and transition upward in central section 174 such that moveable cutoff element 54 transitions vertically upward and away from mold 32 until feedbox 40 reaches retracted position 102 where wiper element 126 is again at height H1 above open top 35 of mold 32.

By controlling the height of moveable cutoff element 54 relative to open top 35 of mold 32 via first and second roller pairs 144, 146, 148, and 150 and rails 160 and 162, drive system 60 together with moveable cutoff element 54, is able to vary and control the depth of dry cast concrete deposited in mold cavities 86*a* and 86*b* in a direction from front side 66 to back side 64 of mold 32. According to the embodiment illustrated by FIGS. 5-7, moveable cutoff element 54 controlled by drive system 60 provides more concrete along the front and back sides 66 and 64 of mold 32, which correspond to the textured sides of dry cast concrete blocks being formed by movable liner plates 84*a* and 84*c* of mold cavities 86*a* and 86*b*.

It is noted that any number of rail configurations or rail profiles are possible in addition to that illustrated by FIGS. 5-7. For example, rails 160 and 162 may have a profile which is higher in the middle and lower at the ends relative to mold 32. Also, rails 160 and 162 may have profiles which transition upward and downward several times relative to the top of mold. It is noted that each rail profile will provide a corresponding profile of a depth of concrete remaining in mold 32 after removal of concrete by cutoff bar 50.

Figure 8A:
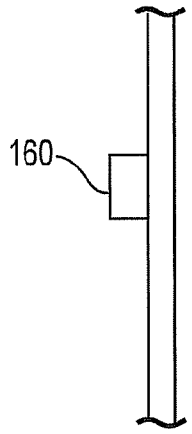
FIGS. 8A-8C illustrate configurations of male rails suitable for use with a cutoff bar system according to embodiments of the present disclosure.
Figure 8B:
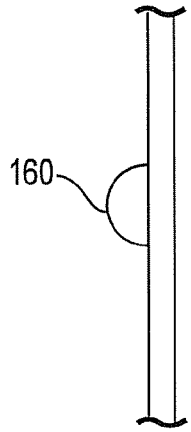
Figure 8C:
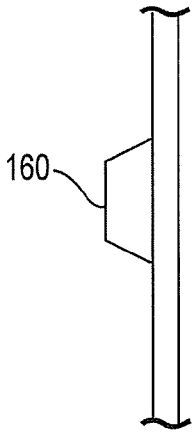

Rails 160 and 162 may also have any number of configurations in addition to the rectangular configuration of the male rails illustrated by above FIGS. 5-7. FIGS. 8A-8C illustrate examples of configurations that may be employed for male configurations of rails 160 and 162. For example, FIG. 8A illustrates rail 160 as having a rectangular configuration, FIG. 6B illustrates rail 160 as having a rounded or semicircular configuration, and FIG. 6C illustrates rail 160 as having an angled of chamfered configuration. Accumulating debris from dry cast concrete block formation process is a major concern, with the rounded and chamfered configurations of FIGS. 8B and 8C having surfaces on which it is more difficult for debris to accumulate relative to the rectangular configuration of FIG. 8A.

Figure 9A:
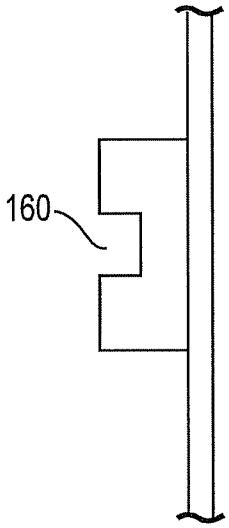
FIGS. 9A-9C illustrate configurations of female rails suitable for use with a cutoff bar system according to embodiments of the present disclosure.
Figure 9B:
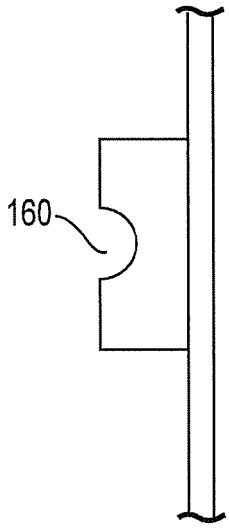
Figure 9C:
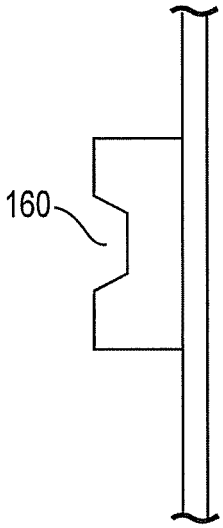

In addition to the male rail configurations illustrated by FIGS. 8A-8C, rails 160 and 162 may also comprise female rails or channels mounted to or formed as part of side walls 164 and 166 of top plate 100. FIGS. 9A-9C illustrate examples of configurations that may be employed for female configurations of rails 160 and 162. For example, FIG. 9A illustrates rail 160 as having a rectangular female configuration, FIG. 9B illustrates rail 160 as having a rounded female configuration, and FIG. 9C illustrated rail 160 as having a chamfered female configuration.

Figure 10:
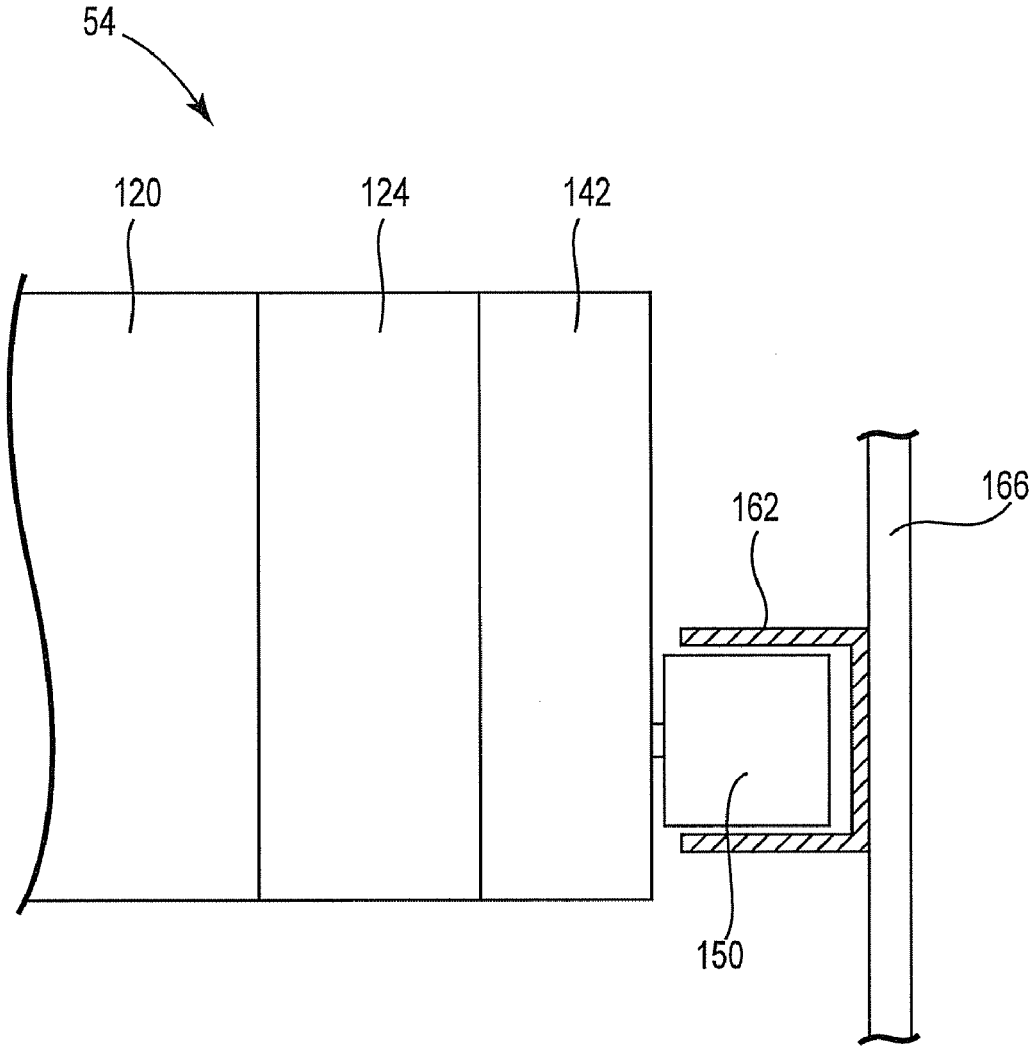
FIG. 10 is a block and schematic diagram illustrating portions of a controllable cutoff bar and drive system according to one embodiment.

When using rails having a female configuration, it is noted that a single roller may be employed on each end of moveable cutoff element 54, such as roller 146 and 150, for example. In such an instance, the rollers travel within the female rail. For example, FIG. 10 is a diagram generally illustrating portions of moveable cutoff element 54 wherein a single roller 150 is employed and travels within track 162 having a female profile.

Figure 11:
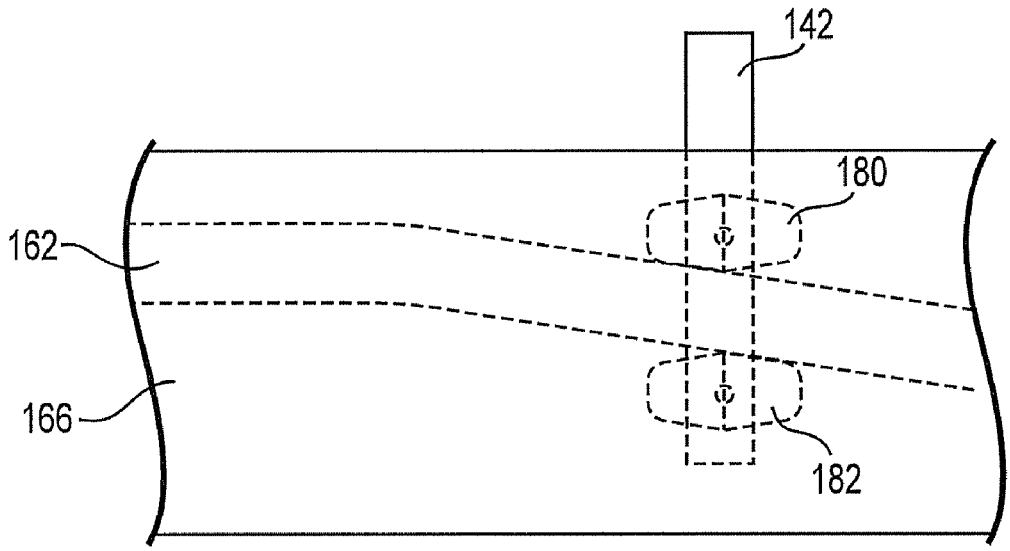
FIG. 11 is a schematic diagram illustrating portions of a drive system according to one embodiment.
Figure 12:
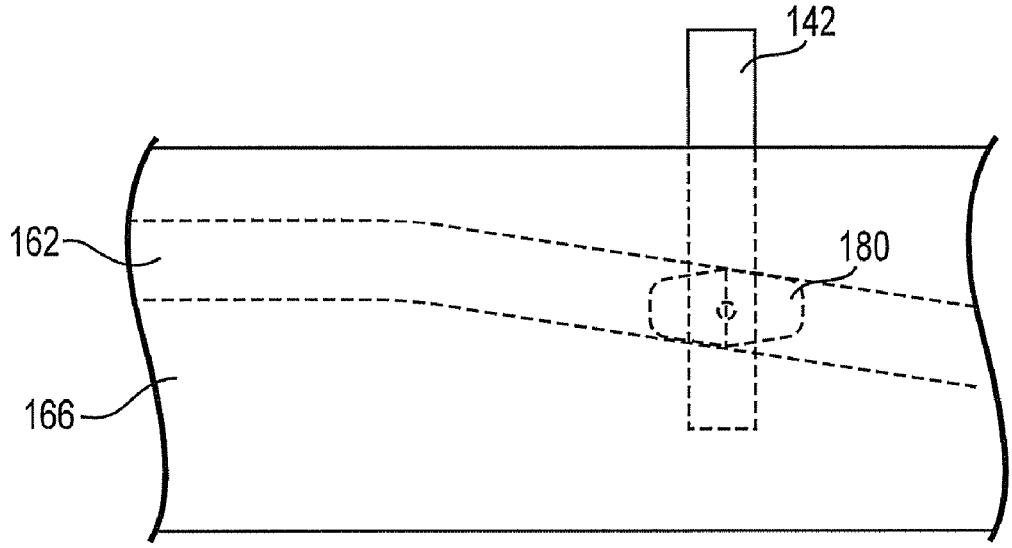
FIG. 12 is a schematic diagram illustrating portions of a drive system according to one embodiment.

In addition to employing rollers, such as rollers 144, 146, 148, and 150, to travel along rails 160 and 162, other types of guide elements may be employed, such as slide elements, for example. FIG. 11 is a side view generally illustrating one example of an embodiment where a pair of slides 180 and 182 are employed in lieu of rollers 148 and 150 and ride along mail rail 162. FIG. 12 is a side view generally illustrating one example of an embodiment where a single slide 182 is employed in lieu of rollers 148 and 150 and ride within female rail 162.

Figure 13:
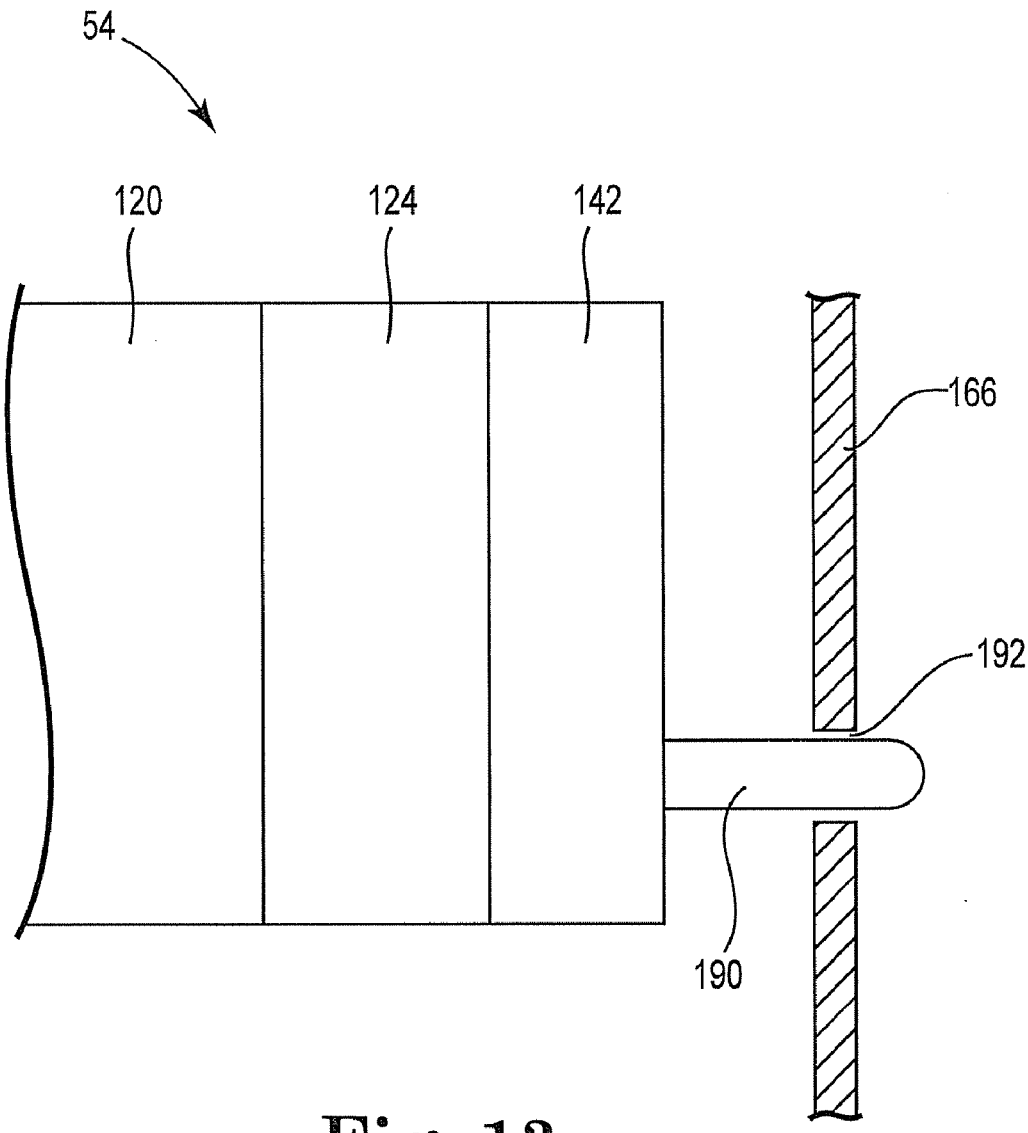
FIG. 13 is a block and schematic diagram illustrating portions of a controllable cutoff bar and drive system according to one embodiment.

According to one embodiment, in lieu of providing rails 160 and 162, slots are cut formed in sidewalls 164 and 166 of top plate 100, and in lieu of first and second pairs of rollers 144, 146 and 148, 150, and pins are mounted to carriage elements 140 and 142 in lieu of rollers, wherein the pins ride within and follow the slots. FIG. 13 is a diagram generally illustrating portions of moveable cutoff element 54 wherein a pin 190 is employed in lieu of rollers 148, 150, wherein pin 190 rides within a slot 192 cut through sidewall 166 of top plate 100 in lieu of rail 162.

Figure 14:
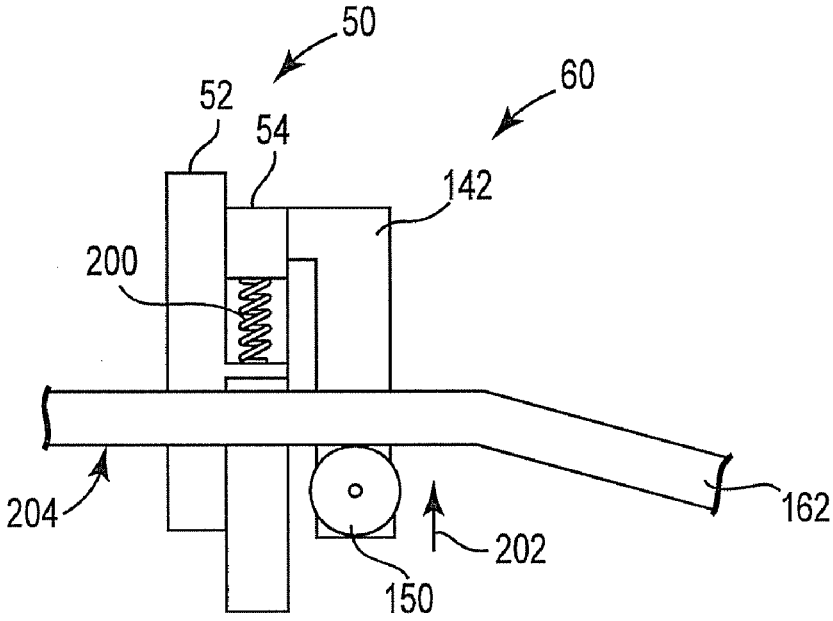
FIG. 14 is a block and schematic diagram illustrating portions of a drive system according to one embodiment.
Figure 15:
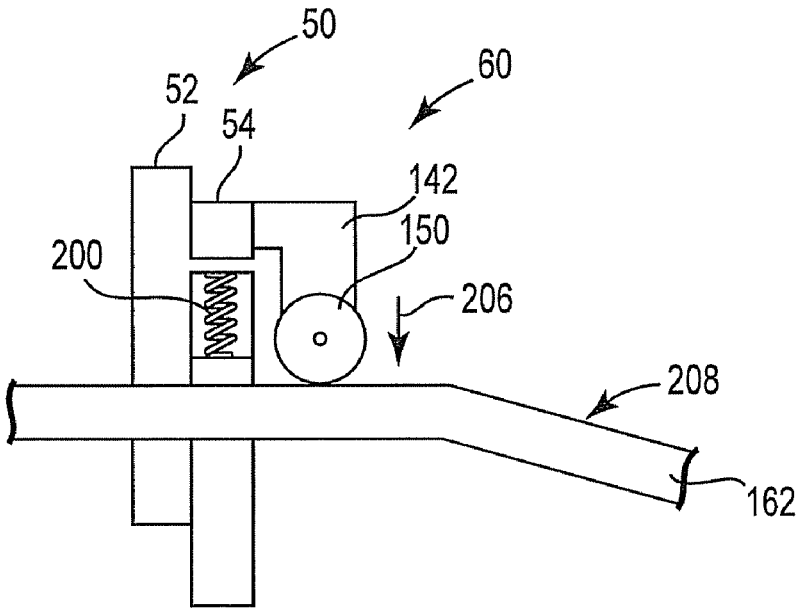
FIG. 15 is a block and schematic diagram illustrating portions of a drive system according to one embodiment.

According to one embodiment, as illustrated generally by FIG. 14, in lieu of employing a pair of rollers, such as roller 148 and 150, to follow male rail 162, drive system 60 employs a single roller, such as 150, and at least one spring 200. According to the embodiment of FIG. 14, roller 150 is positioned below male rail 162 and spring 200 is positioned between fixed portion 52 and moveable cutoff element 54 in a fashion such that spring 200 is in a compressed state and provides a force 202 which pulls up on and holds roller 150 against a bottom surface 204 of male rail 162. As such, roller 150 pulls moveable cutoff element 54 downward when roller 150 transitions downward along rail 162, and spring 200 pulls moveable cutoff element 54 upwards when moveable cutoff element 54 transitions upward or is traveling along a horizontal portion of rail 162.

Similarly, as illustrated by FIG. 14, according to one embodiment, roller 150 is positioned above male rail 162 and spring 200 is again positioned between fixed portion 52 and moveable cutoff element 54, but is positioned in a fashion such that spring 200 is in a compressed state and provides a force 206 which pushes roller 150 downward and holds roller 150 against a top surface 208 of male rail 162. As such, roller 150 pushes moveable cutoff element 54 upward when roller 150 transitions upward along rail 162, and spring 200 pushes moveable cutoff element 54 downward when moveable cutoff element 54 transitions downward or is traveling along a horizontal portion of rail 162.

Although illustrated as being mounted to top plate 100 of mold 32, rails 160 and 162, or slots, such as slot 192, may be positioned or formed on other suitable portions of concrete block machine 30 which remain stationary relative to mold 32 and feedbox 40 during operation. Also, although illustrated primarily herein as being positioned below feedbox 40, it is noted that rails 160 and 162, or slots, such as slot 192, may also be positioned above feedbox 40. Furthermore, although illustrated primarily herein as including two rail (or slots), such as rails 160 and 162, drive system 60 may employ fewer (i.e. one) or more than two rails in other embodiments.

Figure 16:
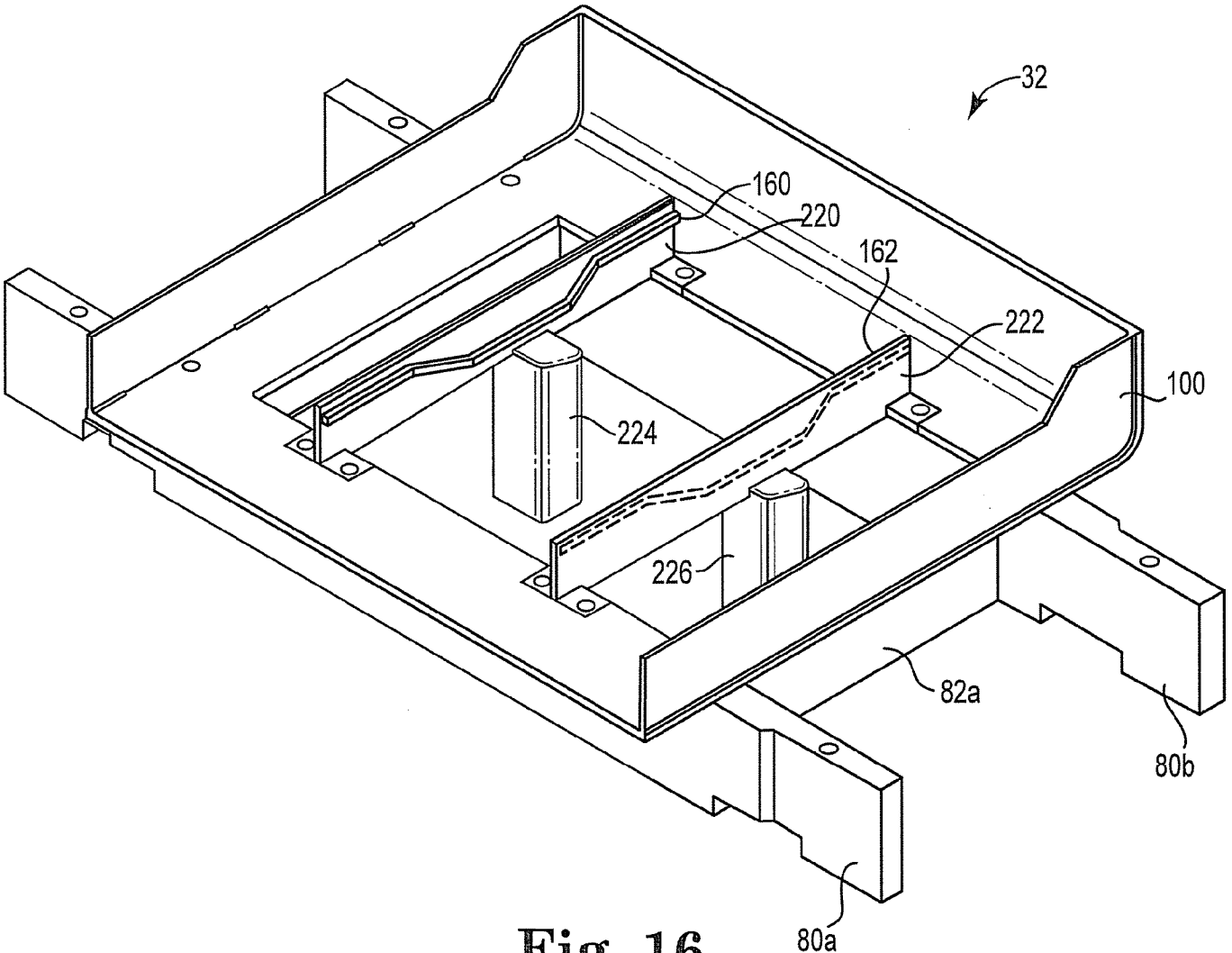
FIG. 16 illustrates a mold including portions of a drive system according to one embodiment.

FIG. 16 illustrates mold assembly 32, along with top plate 100, and further including a core bar assemblies comprising core bar plates 220 and 222 respectively supporting core bars 224 and 226 within mold cavity 34. According to one embodiment, rails 160 and 162 are respectively mounted to core bar plates 220 and 222, in lieu of being positioned on top plate 100.

Figure 17:
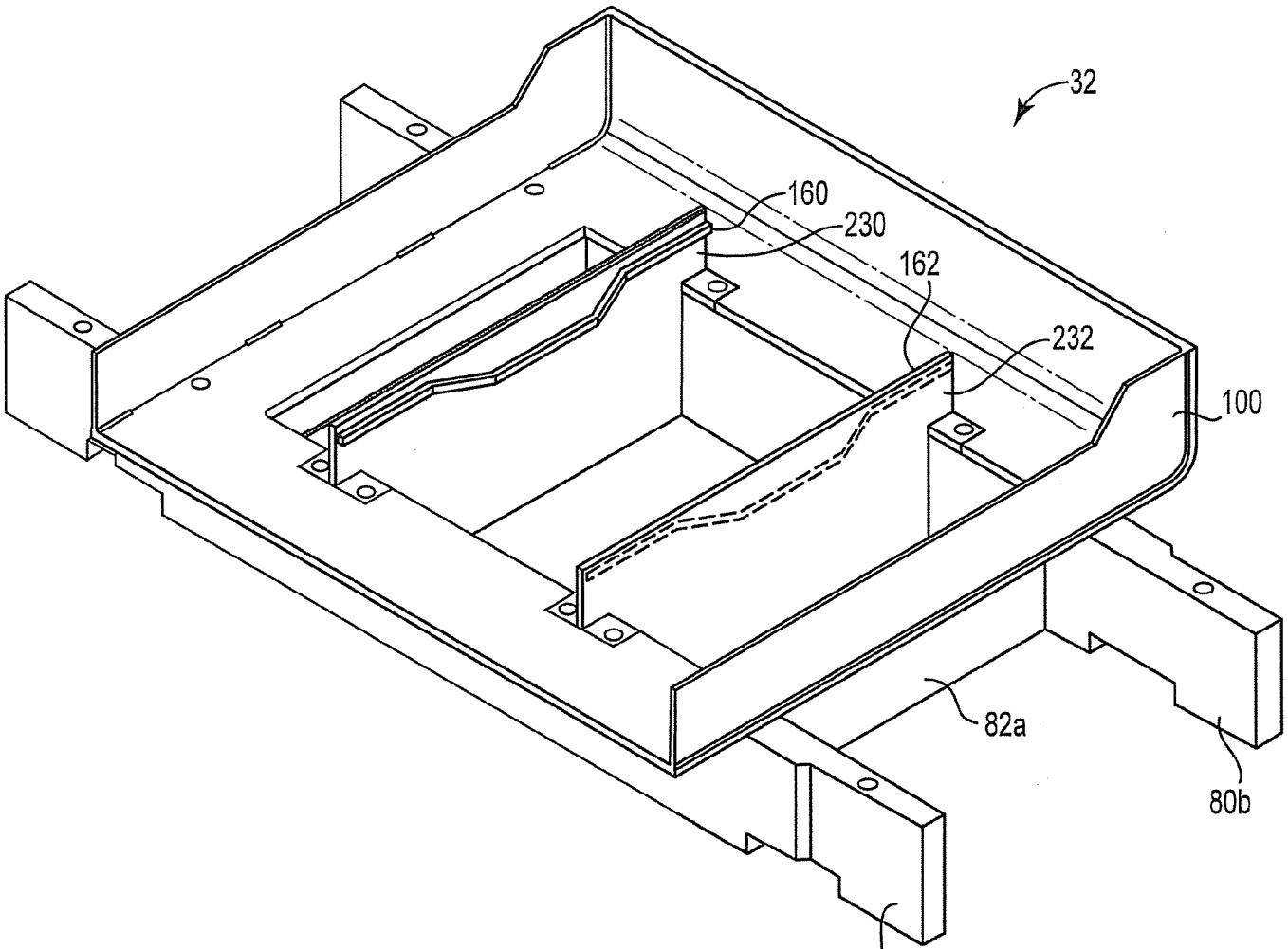
FIG. 17 illustrates a mold including portions of a drive system according to one embodiment.

FIG. 17 illustrates mold assembly 32, along with top plate 100, and further including a pair of division plates 230 and 232 which divide mold cavity 34 into three sub-cavities, each of which is suitable for forming a molded dry cast concrete block. According to one embodiment, rails 160 and 162 are respectively mounted to division plates 230 and 232, in lieu of being positioned on top plate 100.

Although not illustrated explicitly herein, wipers, brushes, and other suitable debris clearing devices may be mounted proximate to rollers 142, 146 and 148, 150 and/or slides, such as slides 180 and 182, so as to clear debris from rails 160 and 162 and to ensure proper movement of cutoff bar 50 as rollers 142, 146 and 148, 150 and/or slides of drive system 60 are moved along rails 160 and 162 by feedbox 40. In one embodiment, for example, compressed air is directed along rails 160 and 162 to blow away debris as rollers 142, 146 and 148, 150 are moved along rails 160 and 162 by feedbox 40. In other embodiments, compressed air may be directed directly through rails 160 and 162 directed out of ports therein to direct debris away from rails 160 and 162.

Additionally, although not explicitly illustrated, in other embodiments, a lubrication system may be employed to lubricate the rollers/rails and rollers/slides/channels during operation.

It is noted that rails 160, 162, and rollers 144, 146, 148, and 150 may comprise any type of suitable materials. For example, rails 160, 162, and rollers 144, 146, 148, and 150 may comprise metal (e.g., steel, brass), may comprise a plastic or rubber material, or may comprise metal with a rubber or plastic coating. Any number of suitable materials or combinations of materials may be employed.

Although described above as being driven by power provided via movement of feedbox 40, according to other embodiments, moveable cutoff element 54 may be driven separately from but still move in-sync with feedbox 40. For example, according to one embodiment, drive system 60 includes an actuator mounted to feedbox 40, such as an electric motor or a hydraulic piston, for example, wherein the actuator is coupled to and configured to drive moveable cutoff element 54 up and down relative to open top 35 of mold 32. By employing such actuators, drive system 60 can drive moveable cutoff element 54 without use of rails, channel, and slots, for example. In still another embodiment, vertical movement of cutoff bar 50 may be achieved by moving the entire feedbox 40 up/down as it moves from the front 66 to the back 64 of mold 30, such as via use of hydraulics, for example.

Figure 18:
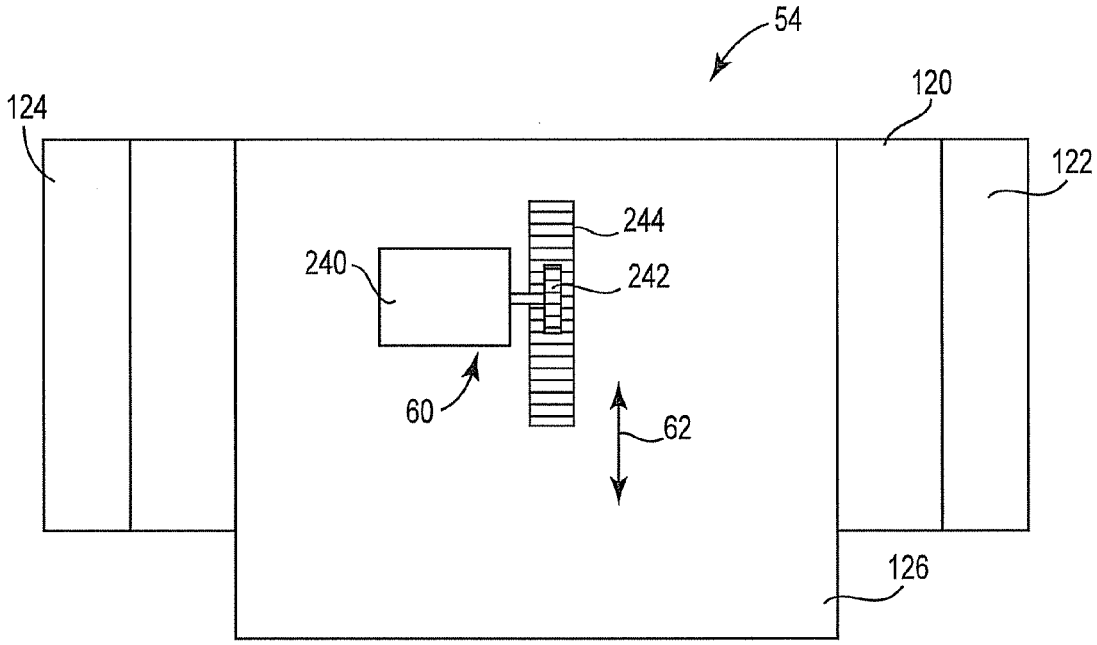
FIG. 18 is a block and schematic diagram illustrating a drive system according to one embodiment.

FIG. 18 is a side view illustrating moveable cutoff element 54 and portions of drive system 60, according to one embodiment, where drive system 60 includes an electric motor 240, a gear 242 coupled to a driven shaft of electric motor 240, and a gear rack 244 coupled to moveable cutoff element 54. According to one embodiment, electric motor 240 is coupled to and moves with fixed portion 52 of cutoff bar 50 and/or to feedbox 40 (not shown). Electric motor 240 is controllably driven in first and second directions (e.g. clockwise and counter-clockwise) such that gear 242, via interaction with gear rack 244, drives moveable cutoff element 54 up and down relative to mold 32, as indicated by direction arrows 62. According to one embodiment, drive system 60 includes controller 76 (see FIG. 1) which controls electric motor 240 so as to drive moveable cutoff element 54 up and down based on a position of feedbox 40 relative to mold 32. According to one embodiment, the position of feedbox 40 relative to mold 32 is communicated to controller 76 via limit switches (not shown) which are activated/deactivated as feedbox 40 moves back and forth over open top 35 of mold 32. According to one embodiment, electric motor 240 is controlled by controller 76 based simply on a known timing of feedbox 40 as it moves back and forth above mold 32.

Figure 19:
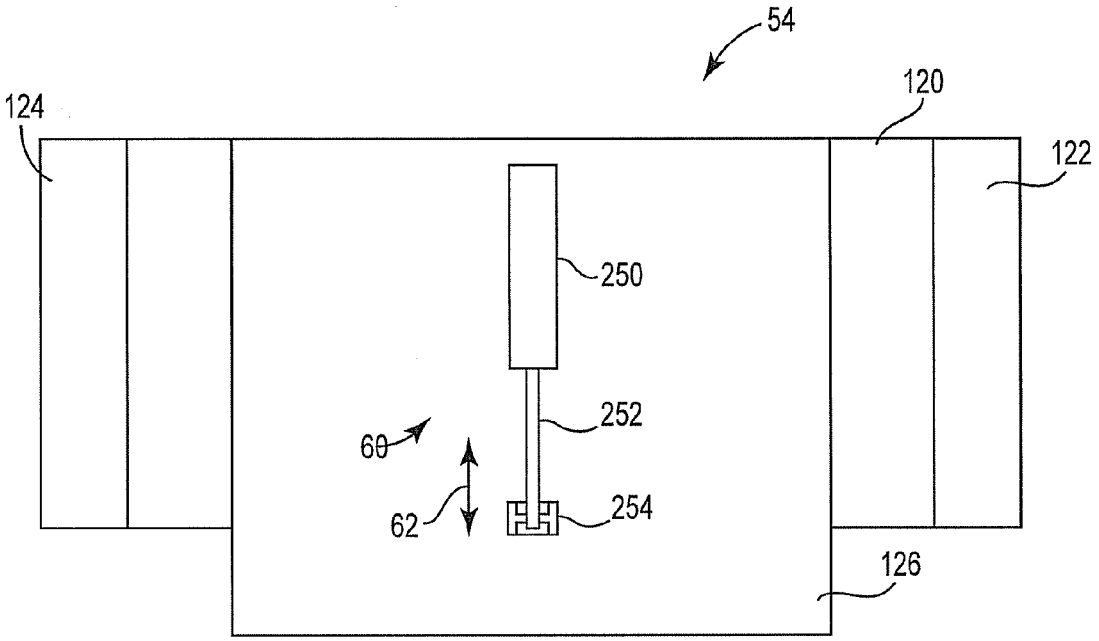
FIG. 19 is a block and schematic diagram illustrating a drive system according to one embodiment.

FIG. 19 is a side view illustrating moveable cutoff element 54 and portions of drive system 60, according to one embodiment, where drive system 60 includes a hydraulic piston 250 (e.g. a pneumatic piston) having a shaft 252 coupled to moveable cutoff element 54 via a linkage 254. According to one embodiment, hydraulic piston 250 is coupled to and moved with fixed portion 52 of cutoff bar 50 and/or to feedbox 40 (not shown). Hydraulic piston 250 is controllably driven to drive shaft 252 back and forth such that shaft 252, via linkage 254, drives moveable cutoff element 54 up and down relative to mold 32, as indicated by direction arrow 62.

According to one embodiment, drive system 60 includes controller 76 (see FIG. 1) which piston 250 so as to drive moveable cutoff element 54 up and down based on a position of feedbox 40 relative to mold 32. According to one embodiment, as described above, the position of feedbox 40 relative to mold 32 is communicated to controller 76 via limit switches (not shown) which are activated/deactivated as feedbox 40 moves back and forth over open top 35 of mold 32. According to one embodiment, piston 250 is controlled by controller 76 based simply on a known timing of feedbox 40 as it moves back and forth above mold 32.

Figure 20A:
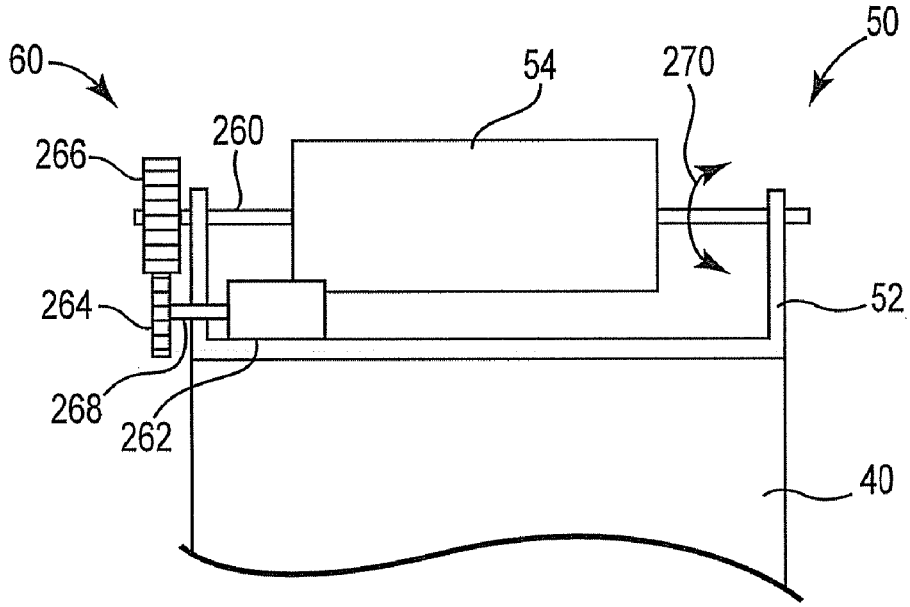
FIG. 20A is a block and schematic diagram illustrating a drive system according to one embodiment.
Figure 20B:
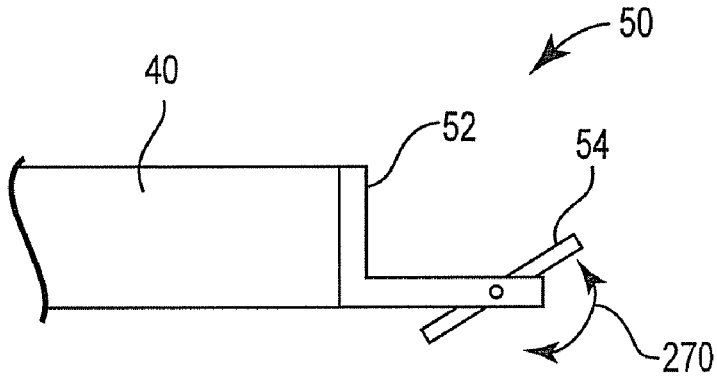
FIG. 20B is a side view illustrating portions of the drive system of FIG. 20A according to one embodiment.

FIGS. 20A and 20B illustrate another embodiment of drive system 60 wherein moveable cutoff element 54 is driven by an actuator rather than through movement of feedbox 40. FIG. 20A is a top view illustrating portions of feedbox 40 as well as portions of cutoff bar 50 and drive system 60. As illustrated, moveable cutoff element 54 comprises a rotatable plate 54 coupled to fixed portion 52 by via a shaft 260. According to one embodiment, drive system 60 includes a motor 262 coupled to feedbox 40 and a pair of gears 264 and 266 respectively coupled to a shaft 268 of motor 262 and to shaft 260 of moveable cutoff element 54.

Motor 262 is controllably driven in clockwise and counter-clockwise directions such that gear 264, via interaction with gear 266, drives moveable cutoff element 54 in a clockwise and counter-clockwise direction, as indicated by rotational arrow 270 in the partial side view of FIG. 20A as illustrated in FIG. 20B. By rotating moveable cutoff element 54 is this fashion, drive system 60 adjusts the position of moveable cutoff element 54 relative to open top 35 of mold 32. According to one embodiment, drive system 60 includes controller 76 which controls motor 262 based on a position of feedbox 40 relative to mold 32. According to one embodiment, the position of feedbox 40 relative to mold 32 is communicated to controller 76 via limit switches (not shown) which are activated/deactivated as feedbox 40 moves back and forth over open top 35 of mold 32. According to one embodiment, electric motor 240 is controlled by controller 76 based simply on a known timing of feedbox 40 as it moves back and forth above mold 32. According to one embodiment, motor 262 is driven in a counter-clockwise direction such that moveable cutoff element 54 spins in a clockwise direction as feedbox 40 is moved from the extended position 104 to the retracted position 102 such that moveable cutoff element 54 scoops out dry cast concrete from mold 32 when feedbox 40 is at intermediate position 103 (see FIG. 7 for feedbox positions).

Figure 21:
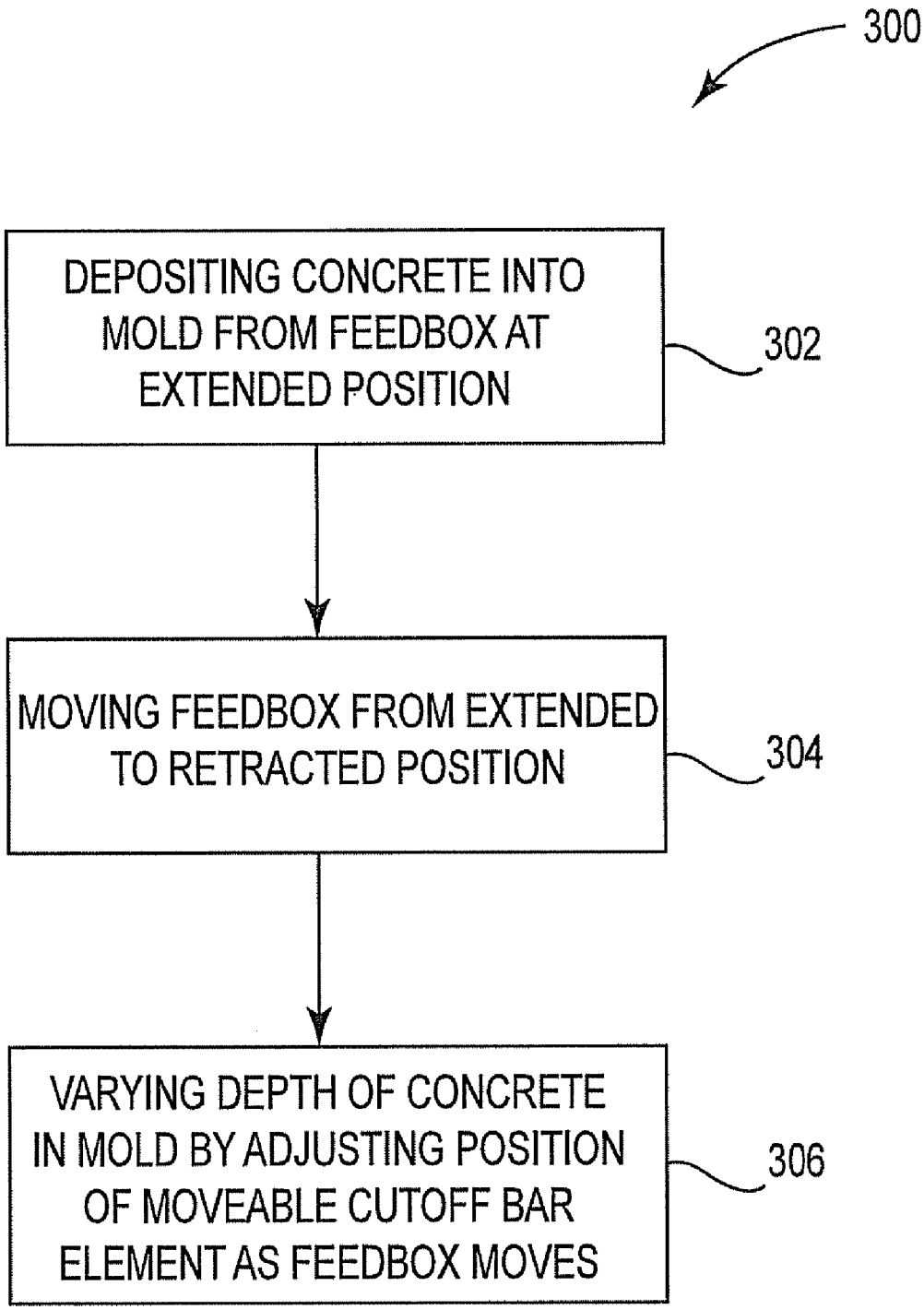
FIG. 21 is a flow diagram illustrating a process for molding a concrete block according to one embodiment.

FIG. 21 is a flow diagram illustrating one embodiment of a process 300 for molding a concrete block according to the present disclosure. Process 300 begins at 302 by depositing concrete from a feedbox into at least one mold cavity of a mold when the feedbox is at an extended position where it is positioned over the mold. At 304, the feedbox is moved from the extended position to a retracted position after depositing concrete in the mold, the retracted position being removed from over the mold. At 306, varying depths of concrete are provided in the at least one mold cavity in a direction of travel of the feedbox by adjusting a distance between a moveable cutoff bar element coupled to the feedbox and a top of the mold so that the moveable cutoff bar element removes varying amounts of deposited concrete as the feedbox moves from the extended position to the retracted position.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A concrete block machine comprising:

a mold including at least one mold cavity;

a feedbox driven back and forth between retracted and extended positions, wherein the feedbox is positioned over a top of the mold deposits concrete in the at least one mold cavity when at the extended position;

a cutoff bar coupled to the feedbox and including a moveable cutoff element; and a drive system coupled to the moveable cutoff element, wherein the drive system moves the moveable cutoff element to adjust a distance between the moveable cutoff element and the top of the mold as the feedbox is driven from the extended position to the retracted position such that the moveable cutoff element in a desired fashion in a direction of movement of the feedbox, wherein the drive system comprises:

at least one track coupled to a portion of the concrete block machine which is fixed relative to the mold, the at least one track extending in a direction parallel to the direction of movement of the feedbox, wherein a distance between the at least one track and the top of the mold varies in a desired fashion across a length of the track; and a guide mechanism coupled to the moveable cutoff element, wherein the guide mechanism follows the at least one track as the feedbox moves from the extended position to the retracted position so that as the guide mechanism follows the at least one track the guide mechanism varies the distance of the moveable cutoff element from the open top of the mold varies by the distance the at least one track varies from the top of the mold.

2. The concrete block machine of claim 1, wherein the at least one track comprises a male rail.

3. The concrete block machine of claim 2, wherein the guide mechanism comprises a pair of rollers positioned opposite one another on opposite sides of the male rail.

4. The concrete block machine of claim 2, wherein the guide mechanism comprises a pair of slides positioned opposite one another on opposite sides of the male rail.

5. The concrete block machine of claim 2, wherein guide mechanism comprises a roller and a spring, wherein the spring provides a force to hold the roller against a surface of the male rail.

6. The concrete block machine of claim 1, wherein the at least one track comprises a slot, and wherein the guide mechanism comprises a pin which rides in the slot.

7. The concrete block machine of claim 1, wherein the at least one track comprises a female rail.

8. The concrete block machine of claim 7, wherein the guide mechanism comprises a roller which rolls within and follows the female rail.

9. The concrete block machine of claim 7, wherein the guide mechanism comprises a slide which slides within and follows the female rail.

10. The concrete block machine of claim 1, wherein the at least one track is coupled to a top plate mounted to the top of the mold.

11. The concrete block machine of claim 1, wherein the at least one track is mounted to a division plate mounted in the at least one mold cavity to divide the mold cavity into sub cavities.

12. The concrete block machine of claim 1, wherein the at least one track is mounted to a core bar assembly positioned in the at least one mold cavity.

13. The concrete block machine of claim 1, wherein the cutoff bar includes a fixed portion having a distance from the top of the mold cavity which does not vary as the feedbox moves from the extended position to the retracted position so that a depth of concrete remaining in portions of the at least one mold cavity corresponding to the fixed portion is substantially constant in the direction of travel of the feedbox.

14. A concrete block machine comprising:

a mold including at least one mold cavity;

a feedbox driven back and forth between retracted and extended positions, wherein the feedbox is positioned over a top of the mold deposits concrete in the at least one mold cavity when at the extended position;

a rotatable plate coupled to the feedbox, the rotatable plate extending in a direction perpendicular to directions in which the feedbox is driven back and forth between the extended and retracted positions;

an electric motor coupled to a shaft of the rotatable plate; and a controller which drives the electric motor to rotate the rotatable plate about the shaft between a vertical position and a horizontal position relative to the top of the mold to vary a distance between an edge of the rotatable plate and the top of the mold based on the position of the feedbox relative to the mold such that the rotatable plate removes varying amounts of concrete deposited in the mold cavity as the feedbox is driven from the extended position to the retracted position so that a depth of concrete remaining in portions of the mold cavity varies in a desired fashion in a direction of movement of the feedbox.

15. The concrete block machine of claim 14, wherein the controller comprises:

a plurality of position sensors positioned along a path of travel of the feedbox which provide indication of a position of the feedbox as it moves along the path of travel from the extended position to the retracted position; and a programmable logic controller which controls the motor to adjust the position of the rotatable plate based on a position of the feedbox as indicated by the position sensors.

16. The concrete block machine of claim 15, wherein the position sensors comprise limit switches.

17. A concrete block machine comprising:

a mold including at least one mold cavity;

a feedbox driven back and forth between retracted and extended positions, wherein the feedbox is positioned over a top of the mold and deposits concrete in the at least one mold cavity when at the extended position;

a cutoff bar coupled to the feedbox and including a moveable cutoff element;

at least one track which is fixed relative to the mold, the at least one track extending in a direction parallel to the direction of movement of the feedbox, wherein a distance between the at least one track and the top of the mold varies in a desired fashion across a length of the track; and a guide mechanism coupled to the moveable cutoff element and which follows the at least one track as the feedbox moves from the extended position to the retracted position and varies the distance of the moveable cutoff element from the open top of the mold and removes varying amounts of concrete deposited in the mold cavity so that a depth of concrete remaining in portions of the mold cavity corresponding to the moveable cutoff element varies in a direction of movement of the feedbox.

18. The concrete block machine of claim 17, wherein the cutoff bar includes a fixed portion having a distance from the top of the mold cavity which does not vary as the feedbox moves between the extended and retracted positions so that a depth of concrete remaining in portions of the at least one mold cavity corresponding to the fixed portion is substantially constant in the direction of travel of the feedbox.

19. The concrete block machine of claim 17, wherein the at least one track comprises one of a male rail and a female rail and the guide mechanism comprises one of at least one roller and at least one slide.

20. The concrete block machine of claim 17, wherein the at least one track comprises a slot and the guide mechanism comprises a pin that slides with the slot.

* * * * *